United States Patent [19]

Gaskill et al.

[11] 4,178,572

[45] Dec. 11, 1979

[54] LOAD MANAGEMENT APPARATUS

[75] Inventors: George Gaskill, Hatboro; John Horn, Philadelphia, both of Pa.

[73] Assignee: Gould Inc., Rolling Meadows, Ill.

[21] Appl. No.: 893,209

[22] Filed: Apr. 3, 1978

[51] Int. Cl.[2] ..... H01H 75/00; H01H 77/00

[52] U.S. Cl. ..... 335/14; 335/6; 335/20

[58] Field of Search ..... 335/6, 14, 20, 8, 9, 335/10; 307/38, 39, 40; 219/327

[56] References Cited

U.S. PATENT DOCUMENTS

| | | | |
|---|---|---|---|
| 3,369,202 | 2/1968 | Gryctko | 335/20 |
| 3,906,413 | 9/1975 | Clausing | 335/14 |

*Primary Examiner*—Harold Broome

*Attorney, Agent, or Firm*—Ostrolenk, Faber, Gerb & Soffen

[57] ABSTRACT

Load management apparatus constituting a direct replacement for a conventional molded case circuit breaker consists of half-inch wide switching and management modules connected in series between an electrical load and its energizing source. The switching module is a conventional circuit breaker and the management module includes an electro-magnetic contactor. The latter is operated by an overcenter spring mechanism which in turn is operated by remotely controlled solenoids.

14 Claims, 14 Drawing Figures

FIG. 9
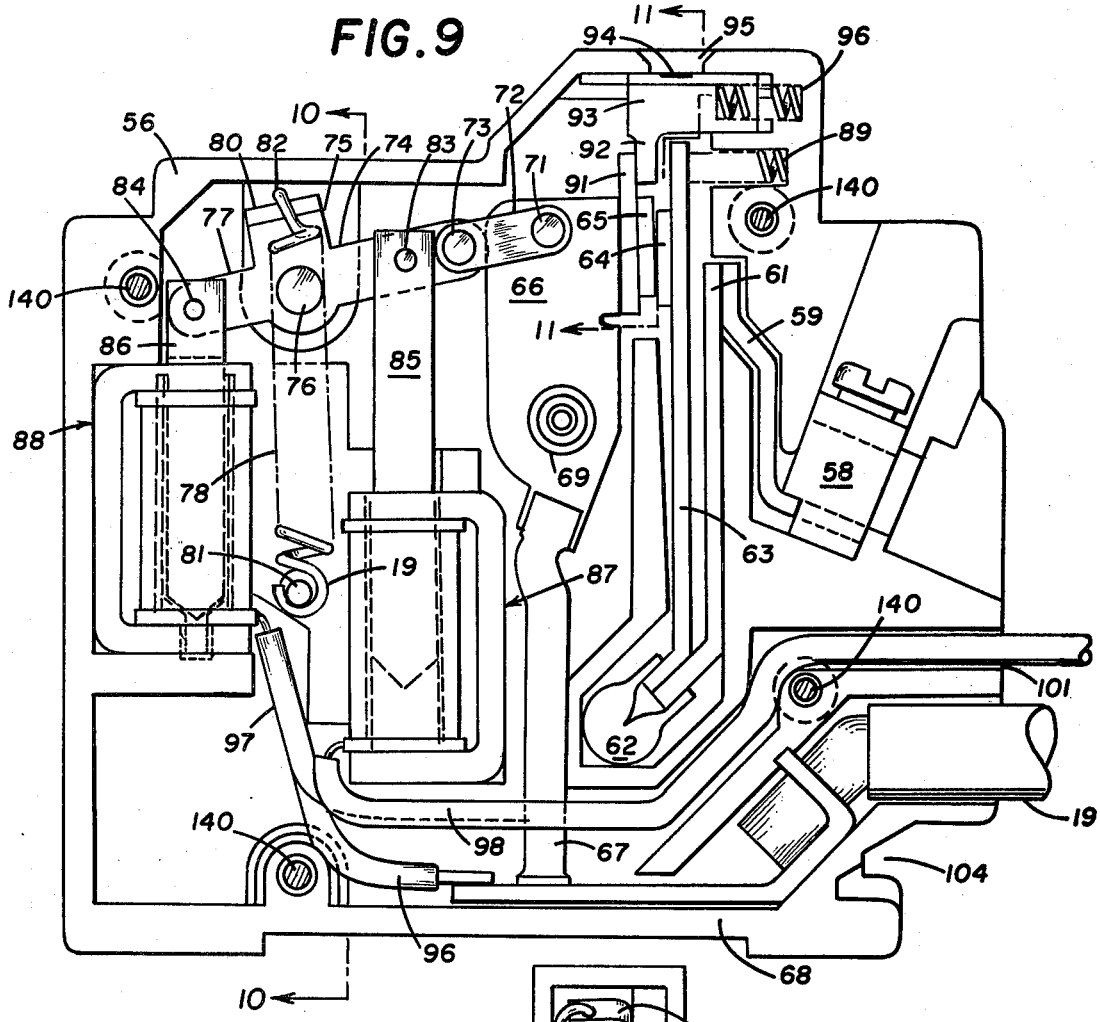
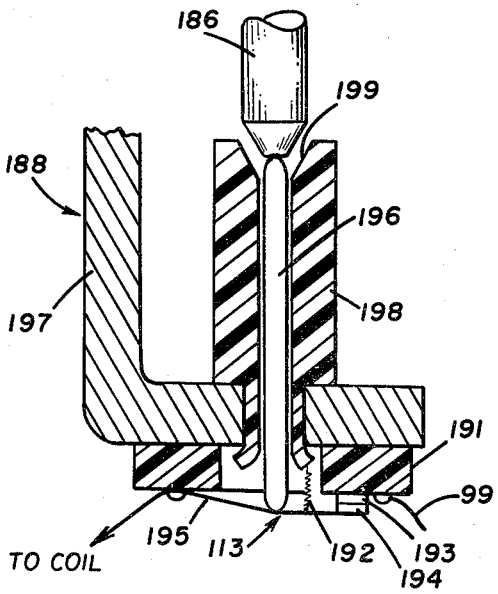
FIG. 12
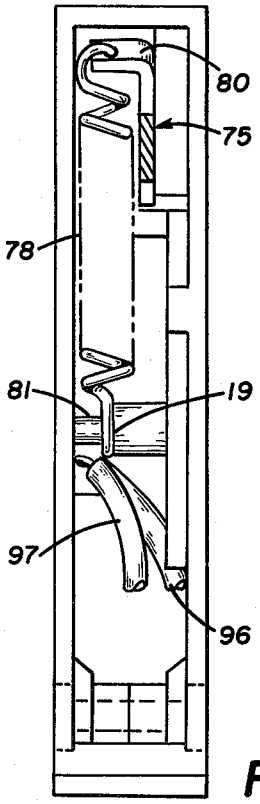
FIG. 10
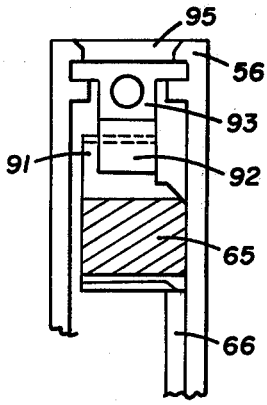
FIG. 11

LOAD MANAGEMENT APPARATUS

Notwithstanding sharply rising costs for producing electrical energy the demand for electricity continues to increase. This demand often exceeds existing capacity. On occasion, excessive demand has caused generating system breakdowns resulting in complete de-energization of large blocks of consumers. In other instances, excess demand has been handled by reducing voltage. This is unsatisfactory to consumers having equipment which functions poorly or ceases to function in the absence of full voltage availability.

In order to obviate the necessity for expanding the capacity for generating electrical energy to meet peak demands of relatively short duration, it has been proposed that the power generating companies be provided with the capability of load management independently of control by the customers. That is, equipment is provided which enables the power company to de-energize selected loads of certain customers without interrupting electrical service to more critical loads. Typically, the load that is interrupted during high demand periods is a non-critical home appliance such as an electric water heater or an air conditioner.

The prior art has suggested the foregoing type of load management by utilizing a contactor connected in series with the circuit breaker through which the appliance in question is energized. The contactor is biased to closed circuit position and is operated electro-magnetically to open circuit position by a control signal which the utility generates at a location remote from the contactor.

According to the instant invention, a contactor-circuit breaker arrangement is constructed for convenient mounting in the same panelboard having the load circuit breaker which formerly controlled energization of the appliance in question. The contactor is constructed so that under fault current conditions the contacts thereof will not tend to blow open. Instead, interruption will take place through separation of the circuit breaker contacts. Standby power is not required to maintain the contactor in either open or closed position in that the contactor is provided with a spring powered overcenter mechanism for operating the contacts both into and out of engagement responsive to control signals generated by the utility company at a location remote from the contact.

Accordingly, the primary object of the instant invention is to provide a novel apparatus for management of electrical loads from a location remote from the load.

Another object is to provide novel load management apparatus which is readily mountable in conventional panelboards at locations designated for conventional circuit breakers.

Still another object is to provide load management apparatus of this type which includes a contactor section having means to prevent contact blowoff under fault current conditions.

A further object is to provide load management apparatus of this type in which a spring powered operating mechanism is utilized for both opening and closing the main circuit of the contactor section.

A further object is to provide load management apparatus of this type which does not require standby power to maintain the contactor either opened or closed.

These objects as well as other objects of this invention shall become readily apparent after reading the following description of the accompanying drawings in which.

Figure 8:
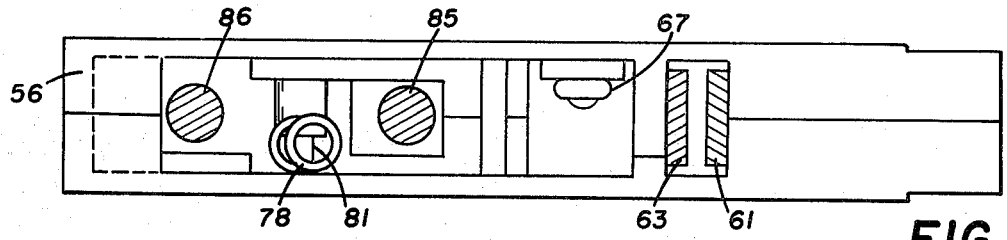
Figure 7:
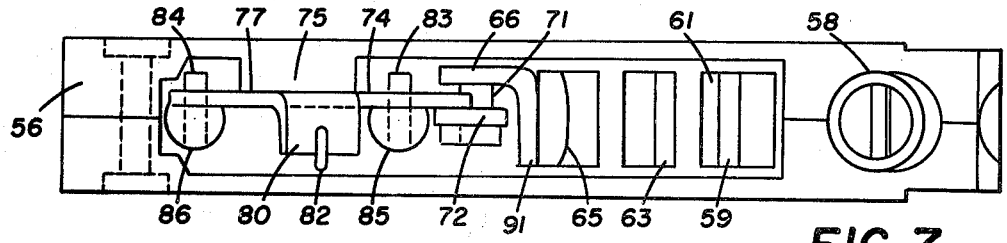
Figure 6:
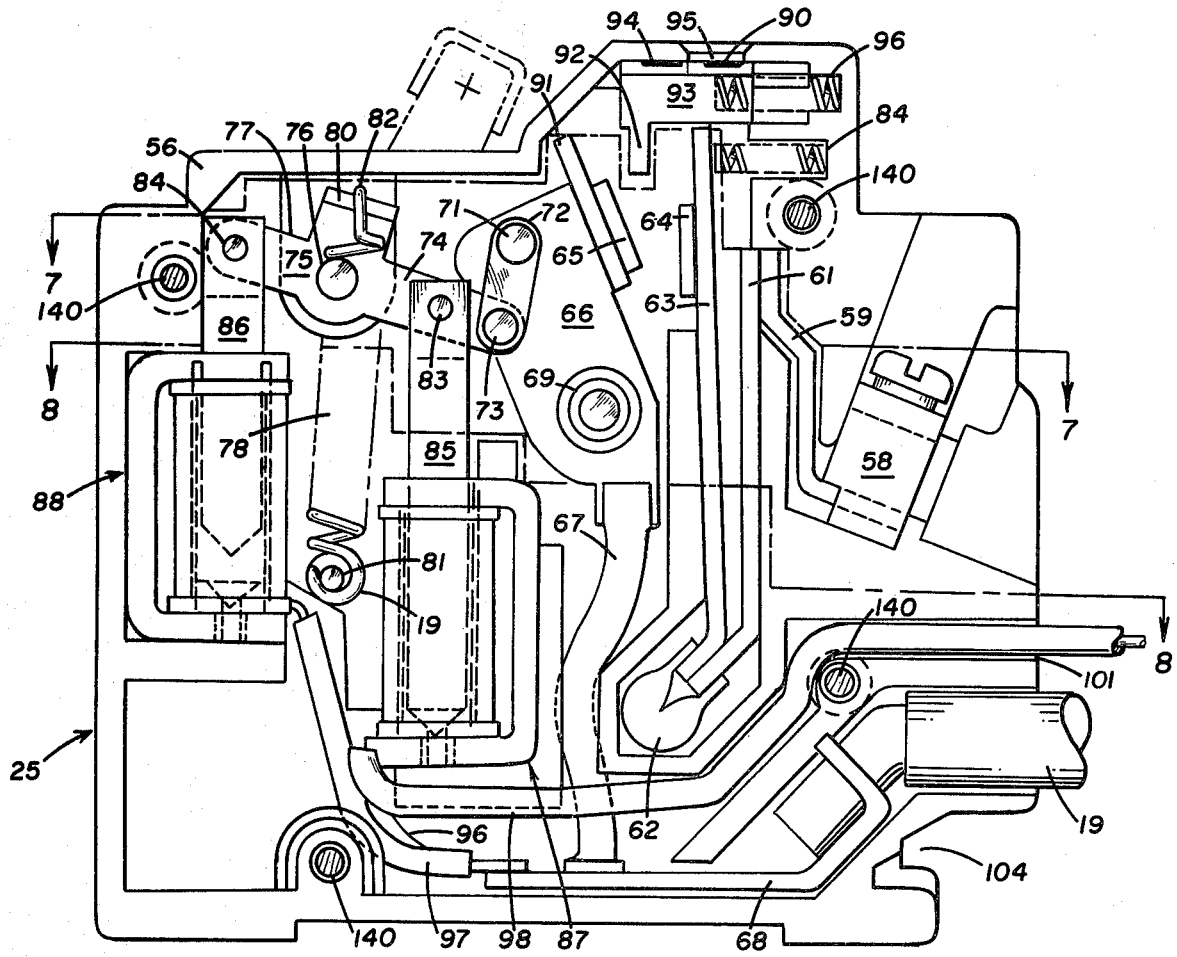
FIG. 6 is a side elevation looking in the direction of arrows 6—6 of FIG. 2 showing the management section with its cover removed to reveal the operating elements thereof.

FIGS. 7 and 8 are cross sections taken through the respective lines 7—7 and 8—8 of FIG. 6 looking in the directions of the respective arrows 7—7 and 8—8.

FIG. 9 is a view similar to FIG. 6. In FIG. 9 the main contacts are shown closed while in FIG. 6 the main contacts are open.

FIG. 10 is a cross-section taken through line 10—10 of FIG. 9 looking in the direction of arrows 10—10.

FIG. 11 is a fragmentary cross-section taken through line 11—11 of FIG. 9 looking in the direction of arrows 11—11.

FIG. 12 is an enlarged fragmentary view of an operating solenoid incorporating an auxiliary switch.

Figure 13:
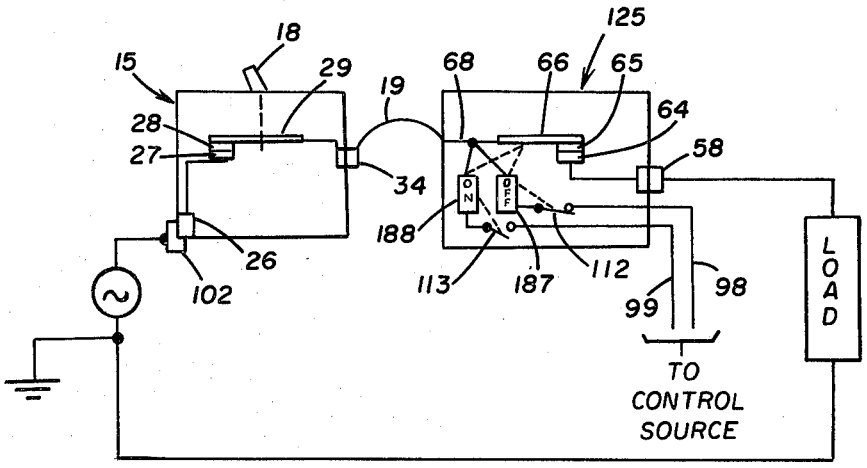

FIG. 13 is a diagram illustrating the electrical connection between a load and a power source through single pole load management apparatus constructed in accordance with teachings of the instant invention.

Figure 1:
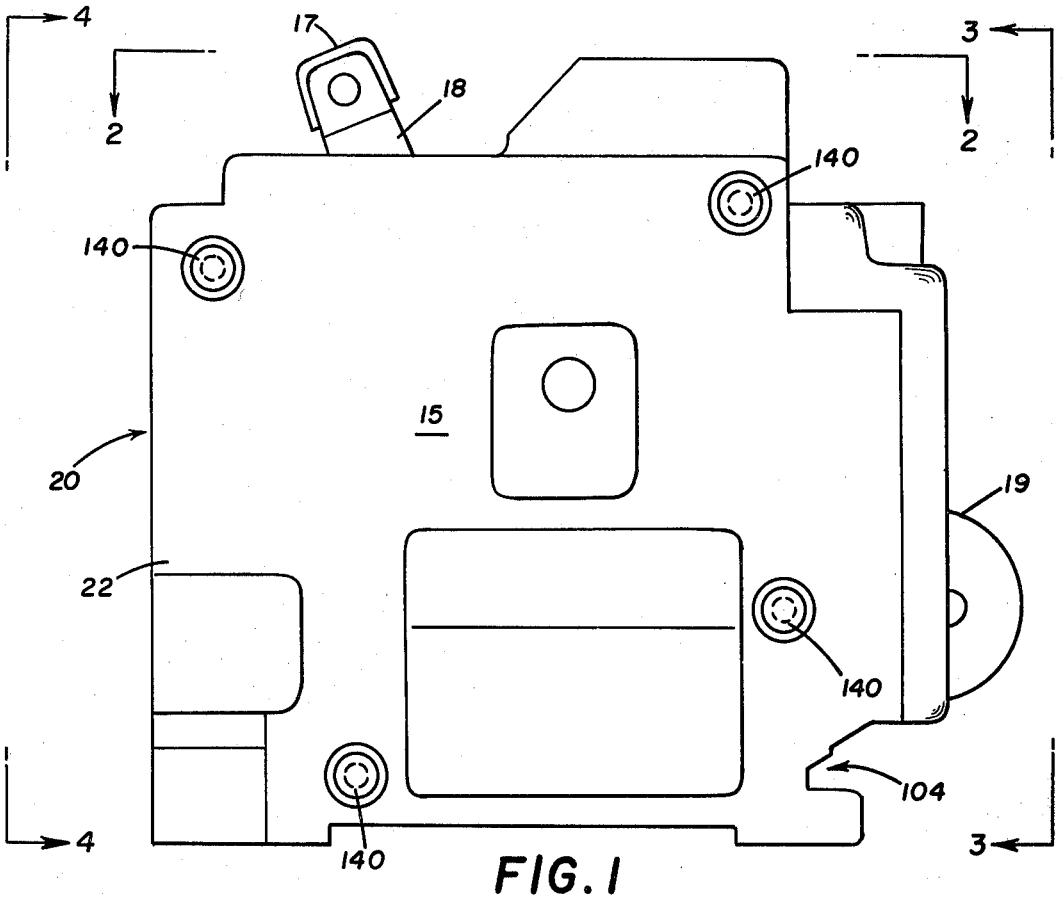
FIG. 1 is a side elevation, looking in the direction of arrows 1—1 of FIG. 2, showing load management apparatus constructed in accordance with teachings of the instant invention.
Figure 2:
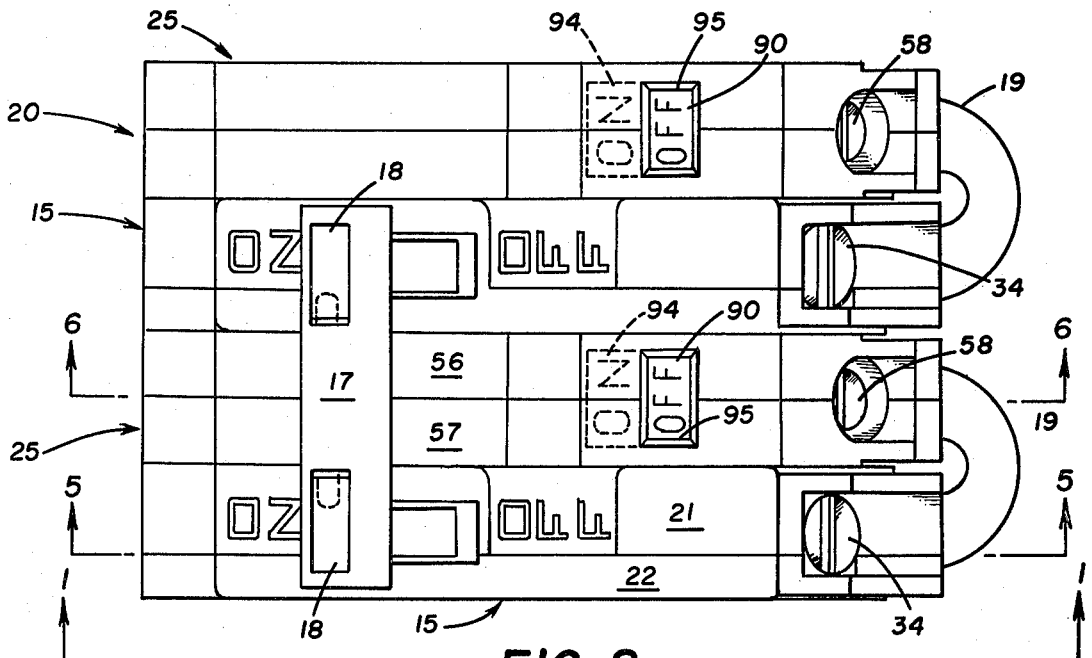
FIG. 2 is a plan view looking in the direction of arrows 2—2 of FIG. 1.

Now referring to the Figures. Load management apparatus 20 is illustrated in FIG. 2 as a two-pole unit. Each pole of apparatus 20 is of identical construction and consists of a manually operable switching section 15 connected in electrical series with a remotely operable management section 25 by a single conductor 19. The switching section handles 18, 18 are mechanically tied together by cap member 17 which extends in front of the management section 25 disposed between the switching sections 15, 15. As seen best in FIGS. 1, 2 and 3, each of the sections 15 and 25 is of substantially the same width and each constitutes a module. In practical embodiments each module is between one-half and one inch wide. All of the modules 15 and 25 are stacked side by side and have profiles (side elevations) having similar though not necessarily identical outlines.

Switching module 15 is a conventional single pole molded case circuit breaker having a narrow housing consisting of base 21 and cover 22 which cooperate to enclose and position the operating elements. The current path through switching module 15 extends from line terminal member 26, stationary contact 27, movable contact 28, movable contact arm 29, flexible conductor 31, bimetal 32 and deformable load terminal strap 33 which terminates in wire grip 34. Manual operating handle 17 is at the forward end of operating member 36 which is mounted on pivot 37. The upper end 38 of movable contact arm 29 is pivotally supported at the lower end of operating member 36, being biased thereagainst by main operating spring 39. The latter is a coiled tension member having its lower end 41 connected to contact arm 29 and its upper end 42 connected to releasable cradle 44 at notch 43 in the forward edge thereof at a point intermediate cradle pivot 46 and latching tip 47.

Figure 5:
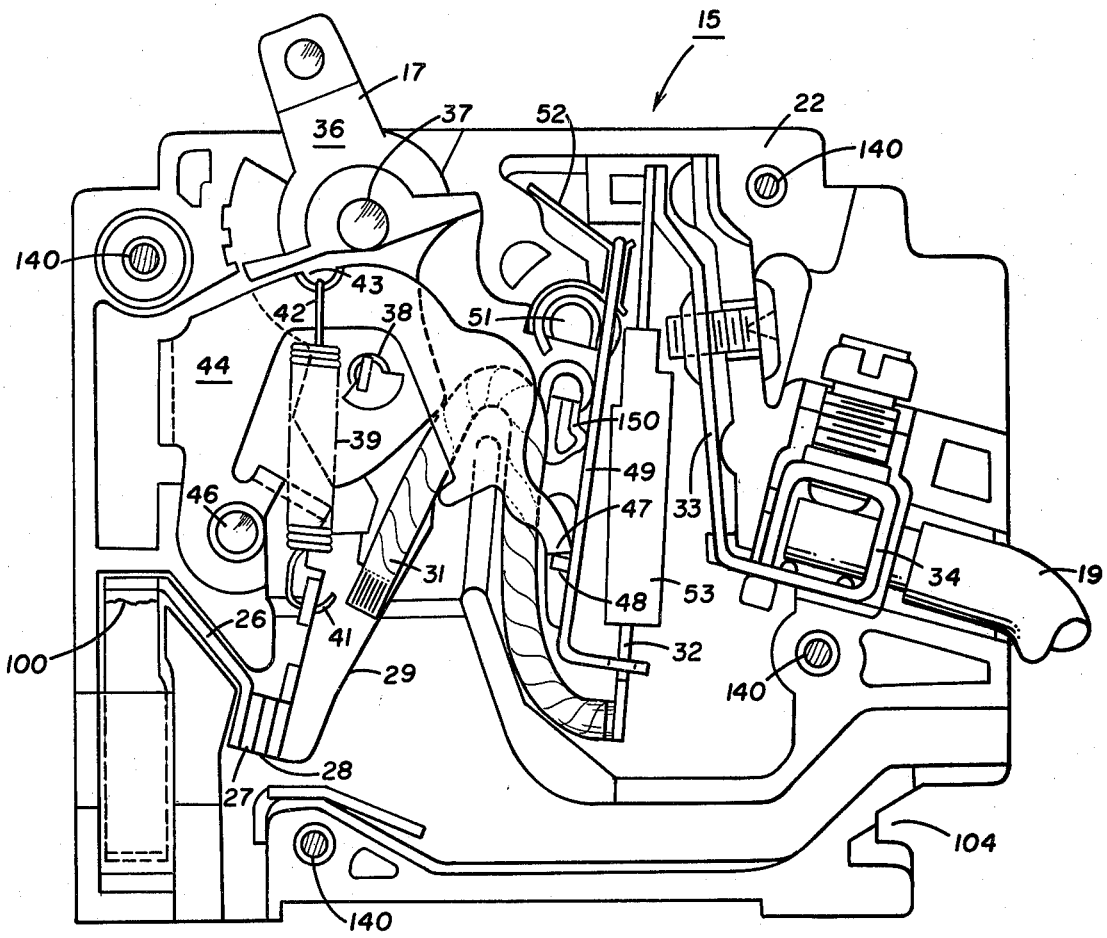
FIG. 5 is a side elevation of the switching section looking in the direction of arrows 5—5 of FIG. 2 with the cover of the switching section removed so as to reveal the operating elements thereof.

When tip 47 supports latch extension 48 of latch member 49, the contact operating mechanism in the reset position shown in FIG. 5. The upper end of latch member 49 is mounted to pivot formation 51 and the lower end of member 49 is offset and provided with a notch through which the lower end of bimetal 32 extends. Wire spring 52 engages the forward end of member 49 biasing the latter toward the latching position shown in FIG. 5. Member 49 constitutes a magnetic armature which is attracted to U-shaped yoke 53 under predetermined overload current conditions. Bimetal 32 extends between the arms of yoke 53 to provide a single engergizing turn. As bimetal 32 heats the rear or lower end thereof moves to the right with respect to FIG. 5 causing latch member 49 to pivot counterclockwise so that latch support 48 releases cradle 44. This repositions the line of action of spring 39 so that the latter pivots movable contact arm 29 counterclockwise thereby separating movable contact 28 from stationary contact 27.

Management module 25 includes a molded insulated housing consisting of base 56 and cover 57. As seen in FIG. 6, the main current path through module 25 consists of wire grip 58, terminal strap 59, stiff elongated conductor 61, short flexible braid 62, elongated stiff conductor 63, relatively stationary contact 64, movable contact 65, movable contact arm 66, flexible braid 67 and terminal strap 68 having jumper 19 connected thereto.

Movable contact arm 66 is pivotally mounted on fixed ring embossment 69 and is pivotally connected by pin 71 to one end of toggle link 72 pivotally connected at its other end by pin 73 to another toggle link provided by arm 74 of rocker number 75. The latter is mounted on fixed pivot 76 which is disposed at the connecting point between oppositely extending arms 74, 77 of member 75. Main operating spring 78 is a coiled tension member whose rear end 79 is connected to fixed support 81 on base 56 and whose other end 82 is connected to an offset portion 80 of rocker 75 disposed forward of pivot 76.

Pins 83, 84 connect the upper ends of the respective plunger pins or armatures 85, 87 of solenoids 87, 88, respectively, to rocker 75 at the respective arms 74, 77 thereof. As seen in FIG. 6, when main contacts 64, 65 are open the line of action for spring 78 extends to the right of rocker pivot 76 so that member 75 is biased clockwise by spring 78 and toggle 72, 74 is collapsed. When solenoid 88 is energized momentarily, armature 86 thereof is drawn rearwardly thereby pivoting rocker 75 counterclockwise. After short counterclockwise motion of rocker 75 the upper end 82 of spring 78 moves to the left of pivot 76 so that the line of action for spring 78 also moves to the left of pivot 76 and the spring energy pivots rocker 75 counterclockwise to the position of FIG. 9. In this position of rocker 75 toggle 72, 74 is extended and movable main contact 65 engages relatively stationary main contact 64. As contacts 64, 65 engage contact 64 is moved slightly to the right of its position in FIG. 6 thereby compressing coiled contact pressure spring 89 which bears against the forward end of conductor 63. In addition, as movable contact arm 66 moves toward the closed circuit position of FIG. 9, forward extension 91 thereof engages tail 92 of indicator number 93 moving the latter to the position shown in FIG. 9 wherein On indication 94 is aligned with window 95. With movable contact arm 66 in the open circuit position of FIG. 6, coiled biasing spring 96 urges indicator 93 to a non-indicating position wherein Off indication 90 is no longer aligned with window 95. The operation of movable contact arm 66 from the On position of FIG. 9 to the Off position of FIG. 6 is obtained by momentarily energizing solenoid 87 thereby drawing armature 85 thereof rearward and rocking member 75 clockwise until the line of action of spring 78 moves to the right of rocker pivot 76 permitting the forces stored in spring 78 to collapse toggle 72, 74.

Insulated conductors 96, 97 connected to the ends of the operating coils of the respective solenoids 87, 88 are connected to terminal member 68. The other ends of these coils are connected to control leads 98, 99 (FIG. 3) which extend externally of housing 56, 57 through opening 101 thereof.

It is noted that with contacts 64, 65 engaged, currents flow in opposite direction through elongated conductors 61, 63. Under extremely high fault current conditions, a significant repelling force is developed between conductors 61, 63 because of their close proximity. This repelling force urges relatively stationary contact 64 toward movable contact 65 to at least partially neutralize the blowoff forces produced by currents flowing across the junction between cooperating contacts 64, 65.

Figure 4A:
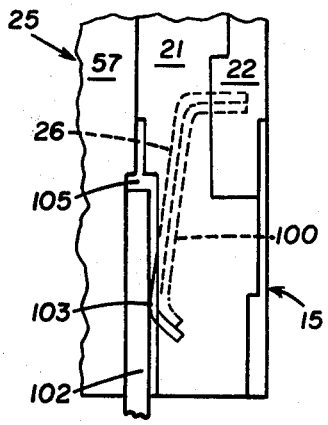
FIG. 4A is a fragmentary portion of FIG. 4 illustrating engagement of the load management apparatus with a terminal blade of a panelboard.
Figure 4:
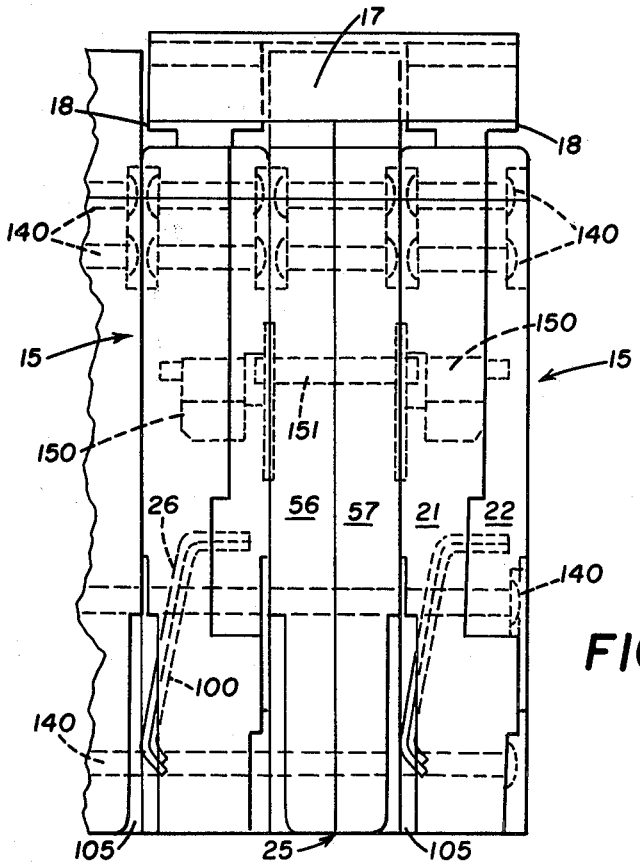
FIG. 4 is a fragmentary end view looking in the direction of arrows 4—4 of FIG. 1.

As seen in FIGS. 4 and 4A, the free end of line terminal 26 remote from stationary contact 27 extends into clearance notch 105 formed by confronting depressions in housing element 21, 57. When apparatus 20 is plugged into a conventional panelboard having a plurality of plug-in blades 102 aligned in a row and spaced on one inch centers, each recess 105 receives a blade 102 which engages member 26. The latter is constructed of spring material which deflects to provide contact pressure at engaging area 103 between contact 26 and blade 102. Steel backup spring 100 bears against blade 102 to increase contact pressure at area 103.

Figure 3:
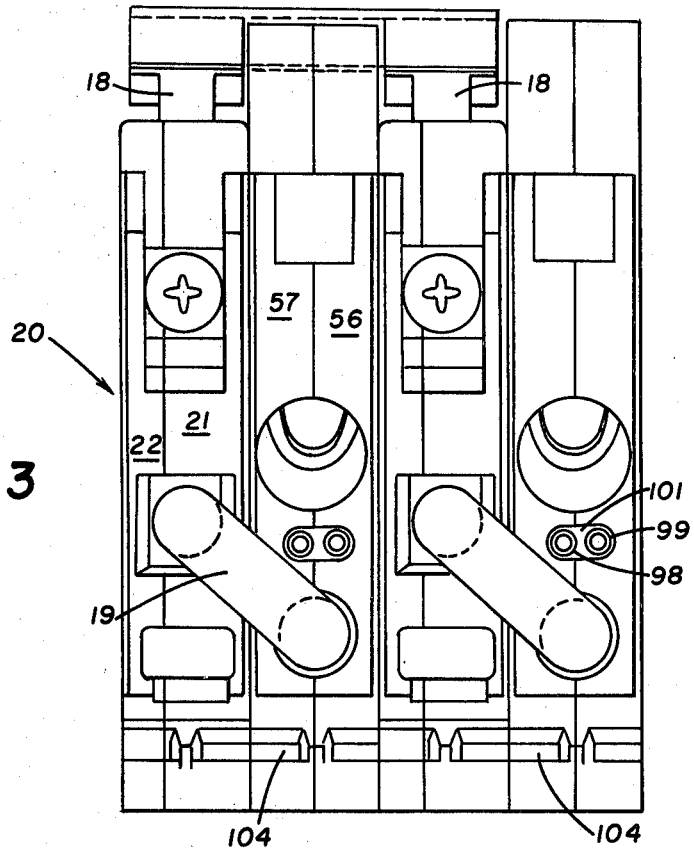
FIG. 3 is an end view looking in the direction of arrows 3—3 of FIG. 1.

As seen in FIG. 3 the load ends of housing sections 21, 57 are provided with aligned recesses which combined form notch 104 to receive a mechanical mounting hook (not shown) of a conventional panelboard.

When control signals on lines 98, 99 are of a continuous nature and the operating solenoid of the management section are so compact that they can withstand only short duration energization, auxiliary switches are provided to interrupt the control signals after the solenoid in question has performed its intended function of moving the line of action for toggle operating spring 78 across a line extending through anchor 81 and rocker pivot 75. Thus, in the schematic of FIG. 13 auxiliary switches 112, 113 are shown connected in series with control signal lines 98, 99, respectively. Auxiliary switches 112, 113, of substantially identical constructions, are operated by the respective Off and On solenoids 187, 188 of management module 125 which, in all other respects, is the same as management module 25.

With reference to FIG. 12 it is seen that solenoid 188 is provided with rod-like armature 186 mounted for axial movement in a rearward or downward direction when the coil (not shown) of solenoid 188 is energized. Rearward movement of armature 186 is arrested by engagement thereof with conical seat 199 in the forward surface of non-magnetic member 198 supported on solenoid frame 197. In the terminal portion of rearward motion for armature 186 the rear end thereof engages the forward end of drive pin 196 which extends through a central bore in member 198. This drives the rear end of pin 196 into contact arm 195 moving the latter rearward to separate contacts 193, 194 of auxiliary switch 113. Contacts 193, 194 are normally closed, being biased to this position by coiled tension spring 192 connected between member 198 and movable contact arm 195. Insulating member 191 on frame 197 supports stationary contact 193 and movable contact arm 195.

It is noted that armature 186 in its rearward movement does not engage pin 196 until after there has been sufficient movement of armature 186 to bring the line of action of spring 78 to the left of the centerline extending through anchor 81 and pivot 76. Thereafter the energy in spring 78 is sufficient to maintain the rear end of armature 186 against seat 199 to assure that auxiliary switch 113 is opened and remains open.

It should be apparent to those skilled in the art that some of the transversely extending rivets 140 secure pairs of housing sections 21, 22 and 56, 57 together so that modules 15, 25 may be handled conveniently even though they are manufactured at different locations, and that the remaining transversely extending rivets 140 secure modules 15, 25 together in a unitary structure constituting load management apparatus 20. As seen in FIGS. 4 and 6 module 15 is provided with pivotally mounted trip lever 150 interposed between cradle 44 and latch member 49. In a manner well known to the art, trip levers 150, 150 of both modules 15, 15 are drivingly connected by non-circular rod 151 which extends through aligned apertures in facing sides of modules 15, 15 and in both sides of the module 25 disposed between modules 15, 15. In particular, rod 151 extends through the center of pivot ring 69.

It is noted that even though the power operator for rocker 75 is shown as consisting of two solenoids 87, 88, it should now be appreciated by those skilled in the art that a single solenoid or other power device may be used to obtain rocking motion of member 75. If a single power device is utilized it is merely necessary to change the direction in which force generated by the device exerted.

Although a preferred embodiment of this invention has been described, many variations and modifications will now be apparent to those skilled in the art, and it is therefore preferred that the instant invention be limited not by the specific disclosure herein, but only by the appending claims.

What is claimed is:

1. Load management apparatus including a manually operable switching section and a remotely operable management section; said switching section including interrupter contact means, a manually operable spring powered first mechanism connected to said interrupter contact means for opening and closing thereof, fault responsive trip means operatively connected to said first mechanism to operate the latter for opening of said interrupter contact means upon the occurence of predetermined fault currents at said switching section; said management section including main contact means connected in series circuit with said interrupter contact means and an electrical load energized through said apparatus, a spring powered second mechanism connected to said main contact means for opening and closing thereof, remotely controlled electrically powered operator means operatively connected to said second mechanism for selectively operating the latter to open and close said main contact means.

2. Load management apparatus as set forth in claim 1 also including first and second main terminals, conductor means defining a main series circuit extending between said terminals; said series circuit including said interrupter and said main contact means; said series circuit also including first and second closely spaced elongated conductors with said stationary contact mounted on said first conductor; said conductors being operatively positioned to have current flow in opposite directions therethrough to create an electrodynamic force acting on said first conductor in a first direction urging said stationary contact toward said movable contact; stop means to limit movement of said first conductor in said first direction to establish a normal open circuit position for said stationary contact.

3. Load management apparatus as set forth in claim 1 in which the main contact means includes a relatively movable contact and a relatively stationary contact; a mechanical biasing means urging said movable contact in a first direction toward said movable contact; stop means to limit movement of said movable contact in said first direction to establish a normal open circuit position for said stationary contact; said second mechanism in closing said main contact means moving said stationary contact slightly from said normal open circuit position in a second direction opposite to said first direction against the force generated by the biasing means.

4. Load management apparatus as set forth in claim 1 in which the second mechanism includes a main spring means, linkage means connecting said movable contact to said main spring means and being operable by the latter to move between first and second positions wherein the main contact means are respectively open and closed; said operator means being operatively connected to said main spring means to selectively move the line of action thereof to opposite sides of a center line; said main spring means operating said linkage means to said first position when said line of action is on one side of said center line and operating said linkage means to said second position when said line of action is on the other side of said center line.

5. Load management apparatus as set forth in claim 4 in which the operator means includes a first solenoid operatively connected to said main spring means to move the line of action thereof to said one side of said center line and a second solenoid operatively connected to said main spring means to move the line of action thereof to said other side of said center line.

6. Load management apparatus as set forth in claim 4 in which the linkage means includes a toggle which is collapsed when said linkage is in said first position and is extended when said linkage is in said second position.

7. Load management apparatus as set forth in claim 6 in which the management section also includes a movable contact arm, said main contact means including a relatively fixed contact and a cooperating relatively movable contact with the latter being mounted at one end of said arm; a fixed first pivot at the other end of said arm; said toggle including first and second links pivotally connected at a movable knee, said first link at the end thereof opposite said knee being pivotally connected to said arm, said second link at a point thereof displaced from said knee pivotally mounted on a fixed second pivot; said main spring means being connected between said second link and a anchoring point; said line of action extending between said anchoring point and said second point.

8. Load management apparatus as set forth in claim 7 in which the operator means includes first and second solenoids connected to said second link at points on opposite sides of said second pivot whereby actuation of said first and second solenoids respectively rocks said second link in opposite directions about said second pivot as a center.

9. Load management apparatus as set forth in claim 1 in which the switching and management sections constitute first and second modules, respectively; said first module including a relatively narrow first housing wherein said interrupter contact means, said first mechanism and fault responsive trip means are mounted; said second module including a relatively narrow second housing wherein said main contact means, said second mechanism and said operator means are mounted; said housing being substantially of equal width and having generally similar profile dimensions.

10. Load management apparatus as set forth in claim 9 also including a load terminal for connecting an external load to said apparatus and a line terminal at which energy for a load connected to the load terminal is supplied to said apparatus; said housings being mounted adjacent side-by-side relationship; said terminals being at opposite ends of said apparatus; said line terminal being positioned to engage an energizing terminal disposed so as to be generally centered in relation to the width of the apparatus.

11. Load management apparatus as set forth in claim 10 in which the load terminal is mounted to said second housing; jumper means extending between said housings and series connecting said main contact means to said interrupter contact means; said jumper means extending externally of said housings at the end of the apparatus having the load terminal disposed thereat.

12. Load management apparatus as set forth in claim 9 in which each of said modules is approximately one half inch wide.

13. Load management apparatus as set forth in claim 9 also including a plug-in type line terminal at one end of said apparatus in the region said modules are adjacent to each other, and a line terminal at the other end of said apparatus for connecting a load to said apparatus.

14. Load management apparatus as set forth in claim 1 also including circuit means through which control signals are applied to said operator means for selective energization thereof, said circuit means including normally closed auxiliary switch means opened by said operator means as the latter moves through a working stroke to interrupt application of control signals being applied to said operator means after completion of a control function.

* * * * *

Notice of Adverse Decision in Interference

In Interference No. 100,747, involving Patent No. 4,178,572, G. Gaskill and J. Horn, LOAD MANAGEMENT APPARATUS, final judgment adverse to the patentees was rendered Feb. 2, 1983, as to claims 1 and 9.

[*Official Gazette May 17, 1983.*]